US010663165B2

(12) United States Patent
Bao

(10) Patent No.: US 10,663,165 B2
(45) Date of Patent: May 26, 2020

(54) ARC LIGHTER

(71) Applicant: Ningbo Yangling Technology Co., Ltd, Yuyao, Zhejiang (CN)

(72) Inventor: Lingzhi Bao, Yuyao (CN)

(73) Assignee: Ningbo Yangling Technology Co., Ltd., Yuyao (CN)

( * ) Notice: Subject to any disclaimer, the term of this patent is extended or adjusted under 35 U.S.C. 154(b) by 234 days.

(21) Appl. No.: 15/890,437

(22) Filed: Feb. 7, 2018

(65) Prior Publication Data

US 2019/0203938 A1 Jul. 4, 2019

(30) Foreign Application Priority Data

Jan. 2, 2018 (CN) ..... 2018 1 0000562
Jan. 2, 2018 (CN) ..... 2018 2 0000856 U

(51) Int. Cl.
*F23Q 2/16* (2006.01)

(52) U.S. Cl.
CPC ..... *F23Q 2/164* (2013.01)

(58) Field of Classification Search
CPC . F23Q 2/16; F23Q 2/164; F23Q 2/287; F23Q 2/173; F23Q 2/32; F23Q 2/34; F23Q 7/24; F23D 14/28; F23D 2900/14381
See application file for complete search history.

(56) References Cited

U.S. PATENT DOCUMENTS 4,149,214 A * 4/1979 Harrison ..... F23Q 3/01 200/276.1
4,502,465 A * 3/1985 Yoshinaga ..... A45D 2/36 126/409
5,697,775 A * 12/1997 Saito ..... F23Q 2/164 431/153
5,897,308 A * 4/1999 Saito ..... F23Q 2/287 431/153
5,967,768 A * 10/1999 Saito ..... F23Q 2/287 431/153
5,980,242 A * 11/1999 Man ..... F23Q 2/287 126/258
6,022,212 A * 2/2000 Saito ..... F23Q 2/164 431/153
6,042,367 A * 3/2000 Saito ..... F23Q 2/164 431/153
6,050,810 A * 4/2000 Huang ..... F23Q 2/164 431/153
6,093,017 A * 7/2000 Saito ..... F23D 11/36 431/153

(Continued)

*Primary Examiner* — Jorge A Pereiro
(74) *Attorney, Agent, or Firm* — Banner & Witcoff, Ltd.

(57) ABSTRACT

According to some aspects a safety lock may be provided for locking a lighter switch, rendering it necessary to push a safety push button forward to separate the locking projection of the locking lever from the engaging groove of the lighter switch, and then press the lighter switch to touch the circuit board switch to operate the lighter (e.g., ignite the lighter's flame). Normally, the arc emission end is disposed in the protective cover which may protect the arc emission end and avoid dangerous situations. When the safety push button is pushed forward, the arc emission end may be pushed out from the protective cover, ready to ignite. Aspects of this disclosure may provide advantages such as simple overall structure, high levels of safety, and safe and reliable use of lighters.

8 Claims, 9 Drawing Sheets

(56) References Cited

U.S. PATENT DOCUMENTS

| | | | | |
|---|---|---|---|---|
| 6,468,070 | B1 * | 10/2002 | Jon | F23Q 2/287<br>431/153 |
| 2005/0084813 | A1 * | 4/2005 | Wong | F23Q 2/164<br>431/153 |
| 2006/0286496 | A1 * | 12/2006 | Tu | F23Q 2/164<br>431/153 |
| 2018/0094810 | A1 * | 4/2018 | Liao | F23Q 2/32 |

* cited by examiner

ARC LIGHTER

This application claims priority to Chinese Patent Application no. 201810000562.4, filed in China on Jan. 2, 2018, by applicant Ningbo Yangling Technology Co., Ltd, and to Chinese Patent Application no. 201820000856.2, also filed on Jan. 2, 2018, also by applicant Ningbo Yangling Technology Co., Ltd. The full disclosure of each is herein incorporated by reference.

FIELD OF USE

Aspects of the disclosure relate generally to a lighter device. More specifically, aspects of the disclosure may provide an improved arc lighter.

BACKGROUND

Lighters, also known as igniters or lighter electrodes, are a commercial and household accessory that operates to create fire for numerous applications, such as in lighting a barbeque, gas stoves, fire places, candles, and the like. However, fire created by lighters (such as open fire lighters or arc pulse lighters) may create a safety issue. For example, children may operate the switch of the lighter due to curiosity or playfulness, carrying a risk of unintentional and damaging fire accidents. As a result, conventional lighters have a very low safety coefficient.

Although lighter designs have been made which attempt to reduce the likelihood of accidental operation, there is an ever present need to improve safety lock devices on lighters. Aspects of the present disclosure provide an arc lighter with a safety lock device to effectively prevent accidental lighter operation and may provide a level of safety.

SUMMARY

Aspects described herein may provide an improved arc lighter incorporating a robust safety lock device.

Embodiments described herein may provide an improved arc lighter. The arc lighter may include a housing, a lighter switch installed to the housing, and a safety lock installed in the housing. The safety lock may comprise a locking lever and a restoring torsion spring installed to the locking lever. The locking lever may be hinged to an inner side of the housing, with a locking projection being disposed at an end of the locking lever. The arc lighter may include a circuit board being installed in the housing. Without being unlocked, in a normal status the locking projection may be engaged into an engaging groove of the lighter switch to prevent the lighter switch from touching a circuit board switch of the circuit board. Thus, pressing the lighter switch directly does not achieve ignition of the lighter. This may prevent children from operating the lighter switch by accident due to curiosity and playfulness, and may avoid causing unnecessary danger.

The lighter may further comprise a control rod seat slidably installed into the housing. The control rod seat may have a safety push button installed thereon, and may also have a flange and a limit slot formed under the safety push button. The locking lever may have a contact end disposed at the other end away from the locking projection. The safety push button may be pushed forward to unlock the safety lock. When the safety push button is pushed forward, the whole control rod seat may slide forward causing the flange to abut the contact end and thus press the contact end of the locking lever. As the locking lever is hinged to an inner side of the housing, through the principle of leverage, the locking projection is lifted and separated from the engaging groove and latched into the limit slot. In this unlocked condition, when lighter switch is pressed, the lighter switch is able to touch and press the circuit board switch thereby causing ignition of the lighter.

In some embodiments, the lighter may comprise a protective cover installed to the front side of the housing. During the default, locked state (normally) the control rod seat slides with respect to the protective cover, falling into the protective cover. When the safety push button is pushed to the front side of the housing, the front end of the control rod seat may be pushed out from the protective cover, and the locking projection thereby separated from the engaging groove and latched into the limit slot, thus placing the lighter in an unlocked status.

The locking projection may be separated from the engaging groove during operation of the lighter, and pressed against the lighter switch to cause ignition of the lighter. A lower end surface of the locking lever under the locking projection may be disposed on an upper end surface of the lighter switch in this situation. Now, a pushing force applied onto the safety push button may be released, and the control rod seat will remain in a pushed status. After the lighter switch is released, the lighter switch is reset, and the locking projection falls into the engaging groove again due to the resilience of the restoring torsion spring. Thus, the control rod seat may be reset to its initial status.

The control rod seat may have a rectangular projection disposed at a rear end of the control rod seat, and the housing may have a restoring spring installed therein, such that an end of the restoring spring abuts against the rectangular projection. The restoring spring may assist in restoring the control rod seat to its initial lock status.

The control rod seat may have an arc emission end disposed at the front end of the control rod seat. Normally, the arc emission end falls into the protective cover. When the safety push button is pushed to the front side, and the whole control road seat slides forward, the arc emission end is extended out from the protective cover in an unlocked status. The control rod seat may have a high-pressure bag installed therein, coupled to the arc emission end and the circuit board. And in some implementations, the housing may have a rechargeable battery installed therein.

The restoring torsion spring may have an end abutting against the inner side of the housing and another end hooking onto the hook projection of the locking lever. The hook projection and the locking projection may be coaxially configured.

Thus, according to some aspects a safety lock may be provided for locking the lighter switch, rendering it necessary to push a safety push button forward to separate the locking projection of the locking lever from the engaging groove of the lighter switch, and then press the lighter switch to touch the circuit board switch to operate the lighter (e.g., ignite the lighter's flame). Normally, the arc emission end is disposed in the protective cover which may protect the arc emission end and avoid dangerous situations. When the safety push button is pushed forward, the arc emission end may be pushed out from the protective cover, ready to ignite. Aspects of this disclosure may provide advantages such as simple overall structure, high levels of safety, and safe and reliable use of lighters.

These features, along with many others, are discussed in greater detail below.

BRIEF DESCRIPTION OF THE DRAWINGS

The present disclosure is illustrated by way of example and not limited in the accompanying figures in which like reference numerals indicate similar elements and in which.

DETAILED DESCRIPTION

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope of the present disclosure. Aspects of the disclosure are capable of other embodiments and of being practiced or being carried out in various ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof.

Figure 1:
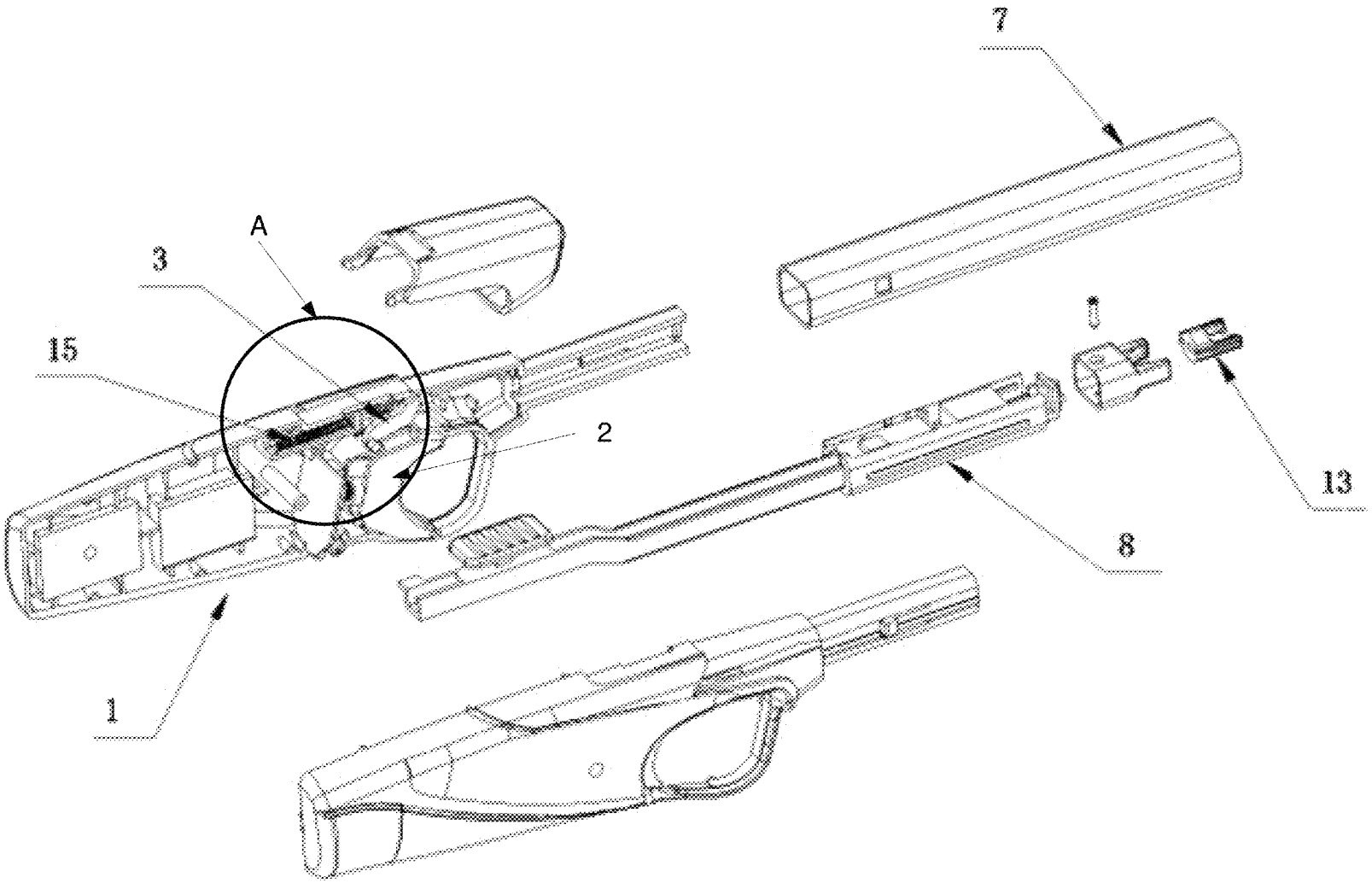
FIG. 1 is an exploded view of an arc lighter in accordance with a first embodiment of this disclosure.
Figure 4:
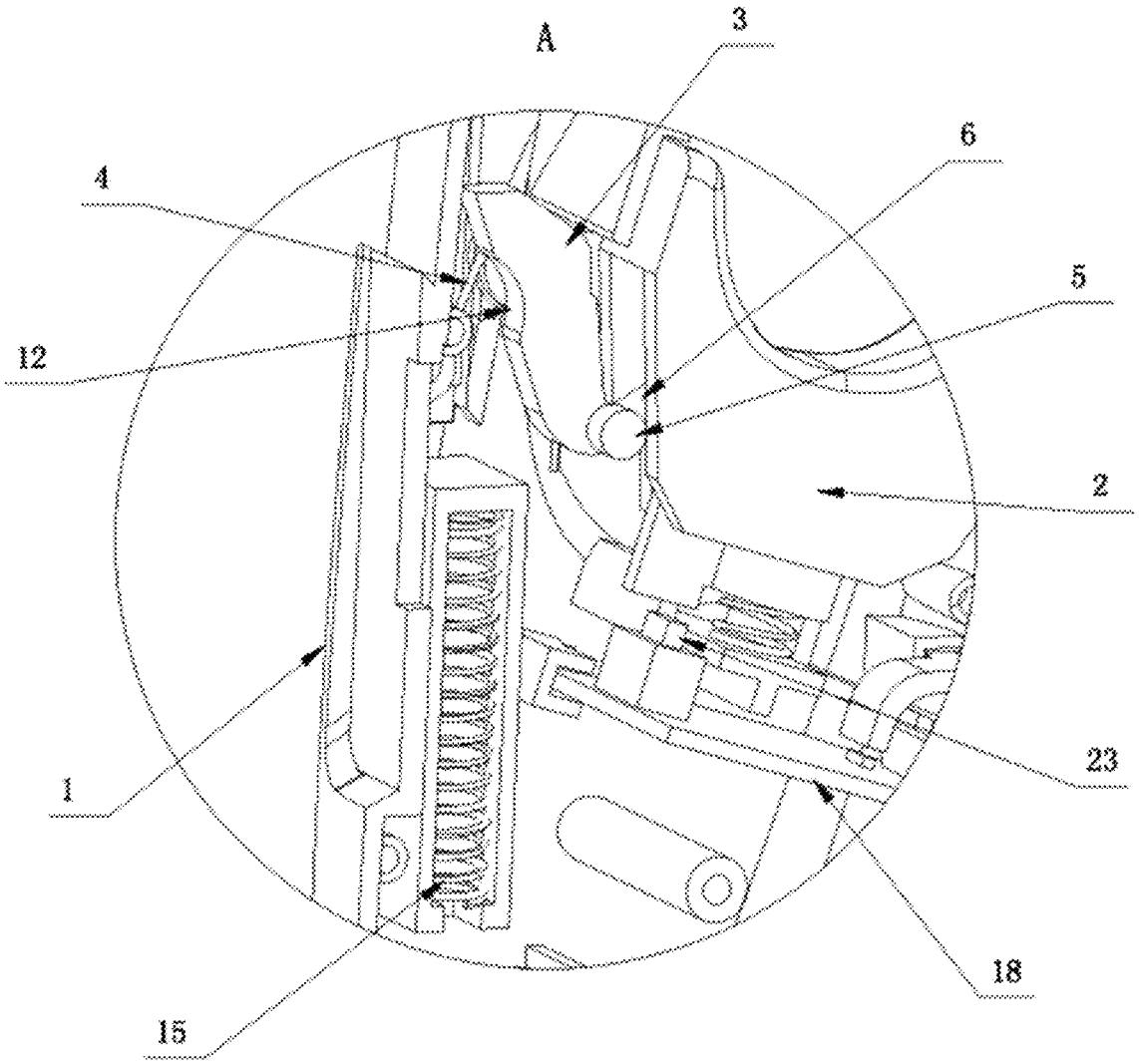
FIG. 4 is a blow-up view of Section A of FIG. 3.

FIG. 1 illustrates a first embodiment of an arc lighter according to some aspects disclosed herein. The arc lighter may comprise a housing 1, a lighter switch 2 installed to the housing 1, and a safety lock installed in the housing 1. Features of the safety lock are included in callout A, and further illustrated in FIG. 4. As illustrated in FIG. 4, the safety lock may comprise a locking lever 3 and a restoring torsion spring 4 installed to the locking lever 3. The locking lever 3 may be hinged to an inner side of the housing 1, with a locking projection 5 is disposed at an end of the locking lever 3 and a contact end 12 disposed at the other end away from the locking projection 5. A circuit board 18 may be installed in the housing 1. Normally, the locking projection 5 is latched into an engaging groove 6 of the lighter switch 2 to prevent the lighter switch 2 from touching a circuit board switch 23 of the circuit board 18. In this situation, directly pressing the lighter switch 2 cannot achieve the operation of the lighter. By keeping the lighter switch 2 and the circuit board switch 23 separated absent unlocking of the safety lock, aspects described herein may prevent children from operating the lighter switch 2 by accident due to their curiosity and playfulness or causing unnecessary danger.

As illustrated in FIG. 1, the lighter may further comprise a protective cover 7 installed at the front side of the housing 1 and a control rod seat 8 slidably installed in the housing 1 and the protective cover 7. The control rod seat 8 may interact with the locking lever 3 of the safety lock to enable operation of the lighter. Further details of the control rod seat 8 and the locking lever 3 are illustrated in FIGS. 2 and 5.

Figure 2:
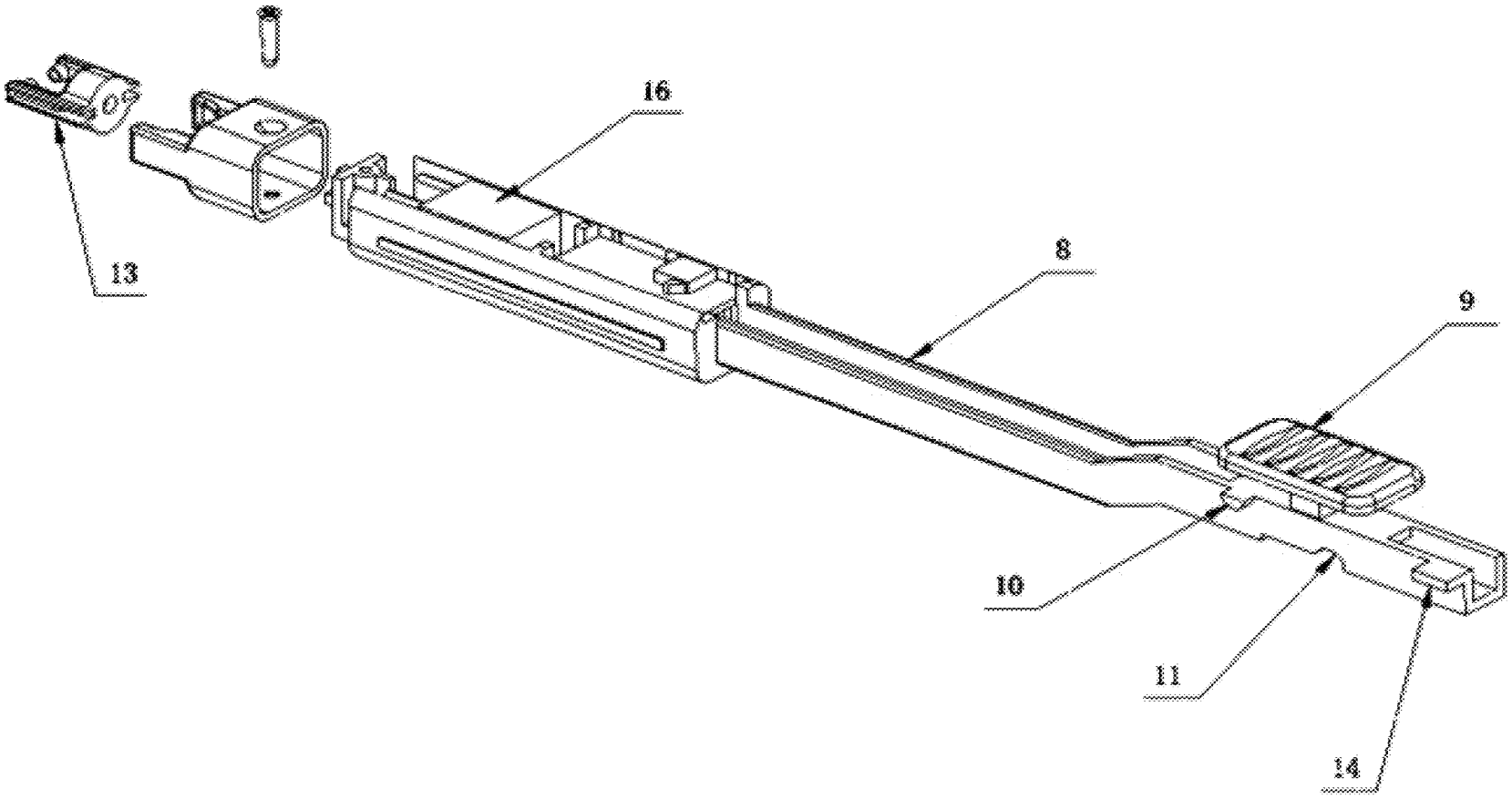
FIG. 2 is a schematic view of a control rod seat of an arc lighter in accordance with the first embodiment of this disclosure.

FIG. 2 illustrates further detail of the control rod seat and related components. In FIG. 2, the control rod seat 8 has a safety push button 9 installed thereon, and control rod seat 8 has a flange 10 and a limit slot 11 disposed under the safety push button 9. In this embodiment, the flange 10 may have a cross-section in a semicircular shape. FIG. 5 illustrates further detail of the locking lever 3 and related components. In FIG. 5, the locking lever 3 has a contact end 12 disposed at the other end away from the locking projection 5. The locking lever 3 may be coupled with a restoring torsion spring 4.

Figure 5:
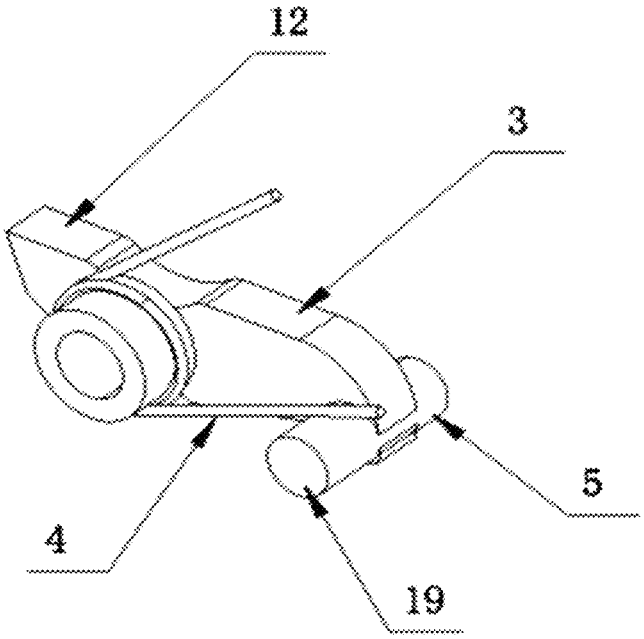
FIG. 5 is a perspective view of a locking lever and a restoring torsion spring of an arc lighter in accordance with the first embodiment of this disclosure.
Figure 10:
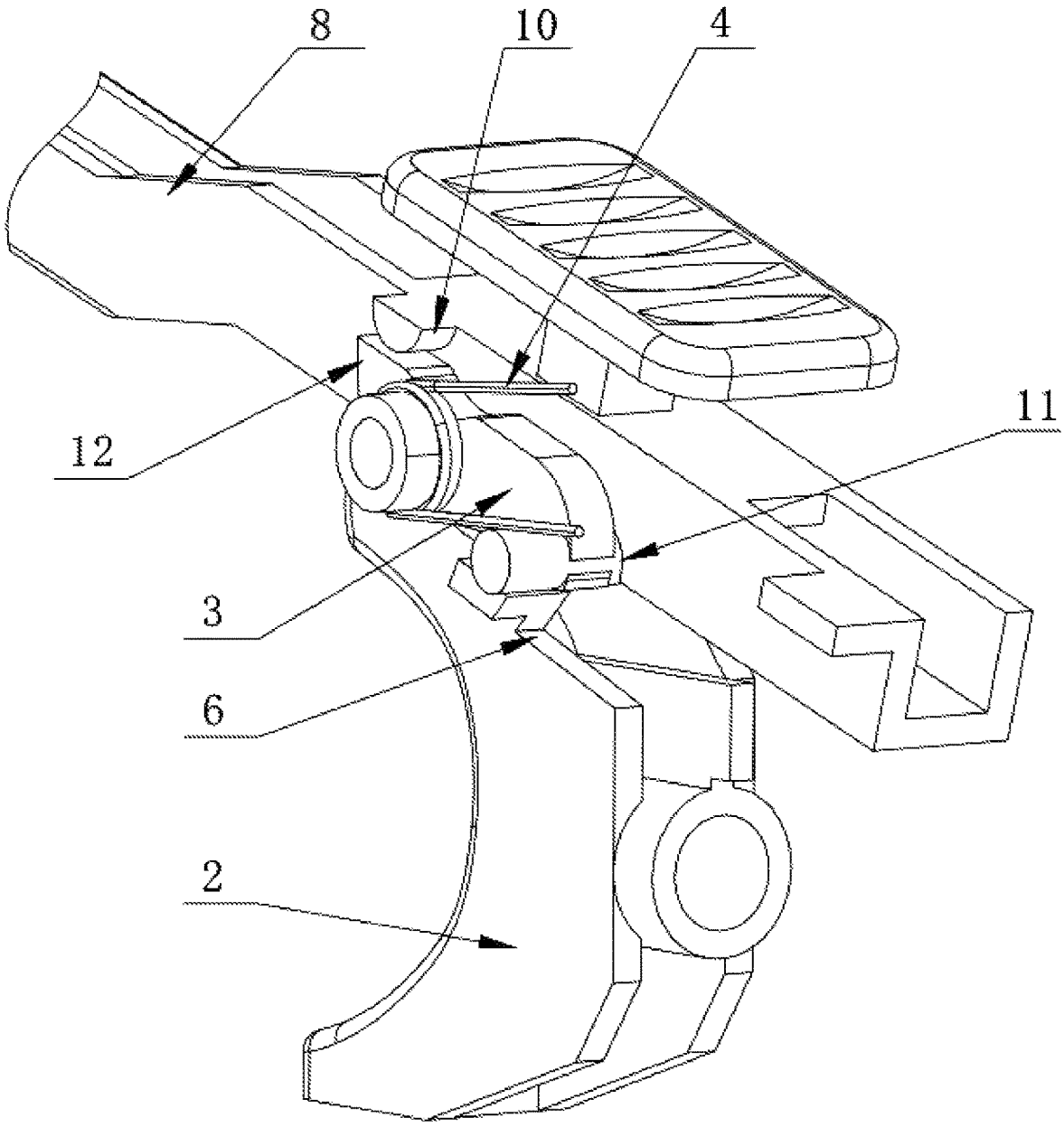
FIG. 10 is another perspective view of the interior of a housing of an arc lighter in accordance with the first embodiment of this disclosure.

Considering both FIGS. 2 and 5, when the safety push button 9 is pushed forward to unlock the safety lock, the whole control rod seat 8 slides forward. The flange 10 is disposed to abut the contact end 12 of the locking lever 3, and the flange 10 may press against the contact end 12. As the locking lever 3 is hinged to an inner side of the housing 1, through the principle of leverage, the locking projection 5 is lifted so that the locking projection 5 becomes separated from the engaging groove 6 (see FIG. 4) and latched into the limit slot 11 (see FIG. 10). The effect of this may be to unlock the safety lock and permit operation of the lighter. Now, when the lighter switch 2 is pressed, such that the lighter switch 2 touches and presses the circuit board switch 23 of the circuit board 18, the lighter may be operated to generate a flame or otherwise ignite. In this embodiment, the circuit board switch 23 may be installed directly onto the circuit board 18.

In the unlocked status, the safety push button 9 may be pushed to the front side, and the front end of the control rod seat 8 may be pushed out to the protective cover 7. The locking projection 5 is separated from the engaging groove 6 and may be latched into the limit slot 11.

Figure 6:
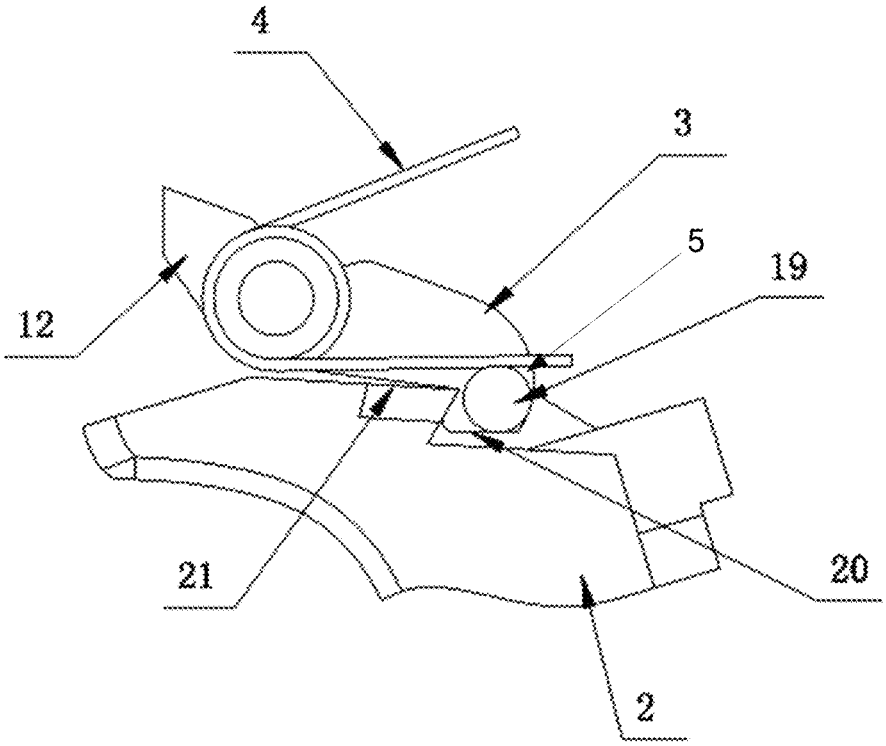
FIG. 6 is a schematic view of a locking lever and a lighter switch of an arc lighter in accordance with the first embodiment of this disclosure.

In FIG. 6, the locking projection 5 is separated from the engaging groove and the lighter switch 2 remains pressed for operation of the lighter. A lower end surface 20 of the locking lever 3 under the locking projection 5 is disposed on an upper end surface 21 of the lighter switch 2. Now, the pushing force applied to the safety push button 9 may be released easily, and the control rod seat 8 will remain situated at a pushing status (unlocked). After the lighter switch 2 is released, the lighter switch 2 may be reset, and the locking projection 5 may fall back into the engaging groove 6 (see FIG. 4) by the resilient pressure of the restoring torsion spring 4. Now, the control rod seat 8 starts to be reset to its initial, locked status.

Figure 7:
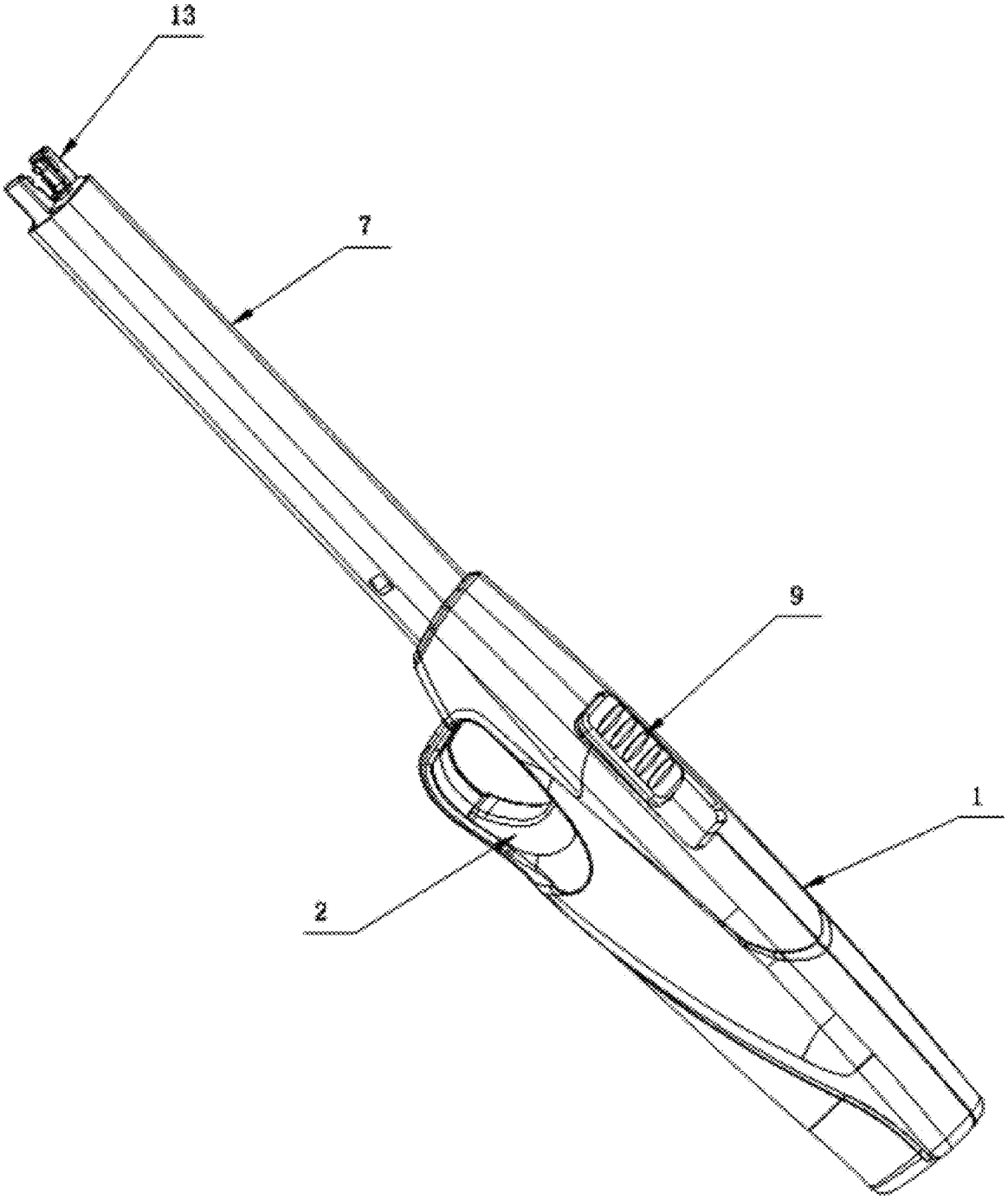
FIG. 7 is a perspective view of a lighter in accordance with the first embodiment of this disclosure, during lighter.

In FIGS. 1 and 2, an arc emission end 13 is installed at the front end of the control rod seat 8. Normally, the arc emission end 13 falls into the protective cover 7. FIG. 7 illustrates that, when the safety push button 9 is pushed to the front side in an unlock status and the whole control rod seat 8 slides forward, arc emission end 13 is extended out from the protective cover 7. The arc emission end 13 may operate as an ignition source during operation of the lighter.

Figure 3:
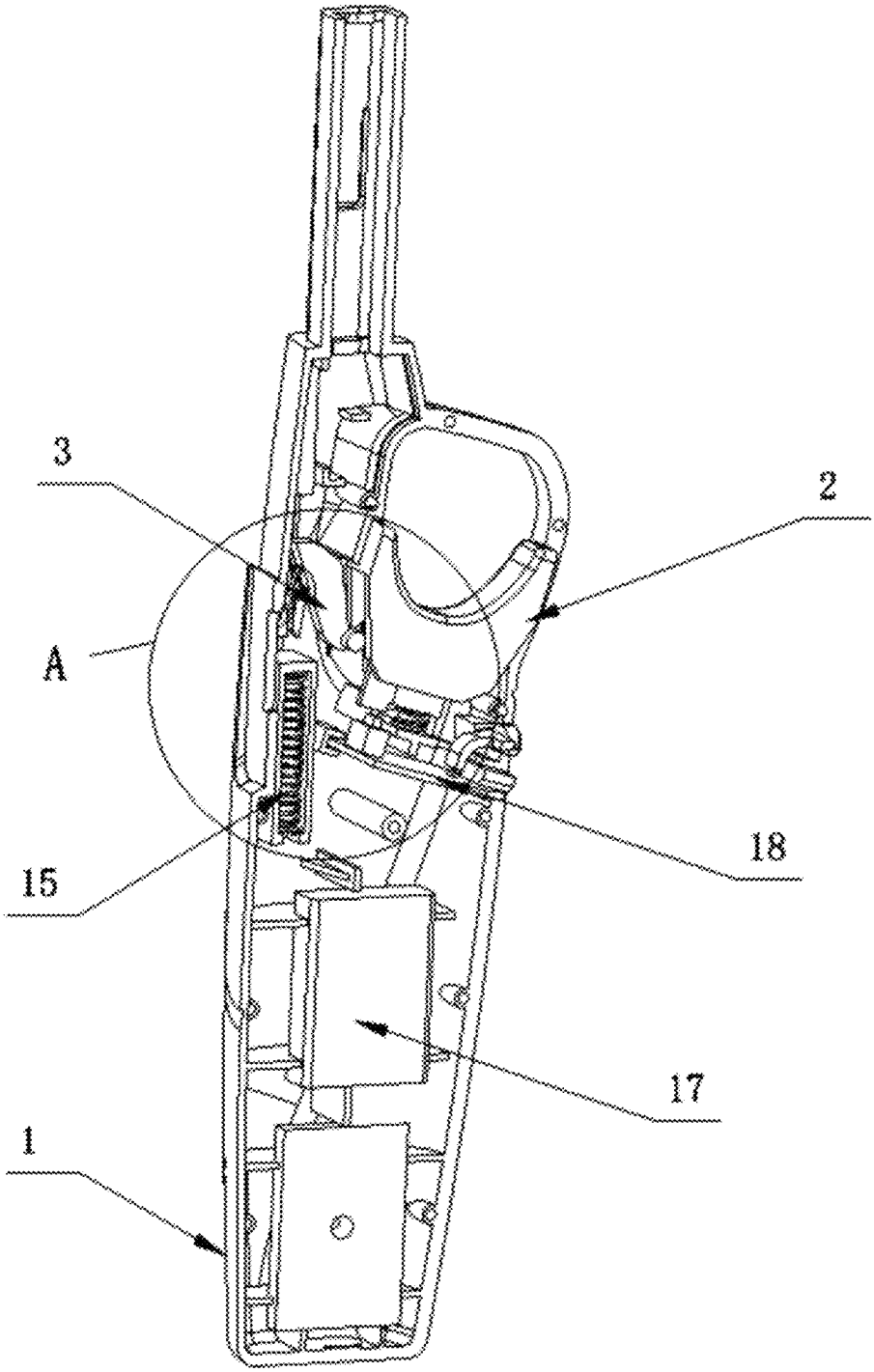
FIG. 3 is a perspective view of the interior of a housing of an arc lighter in accordance with the first embodiment of this disclosure.

As illustrated in FIG. 2, the control rod seat 8 may have a high-pressure bag 16 installed therein. And, as illustrated in FIG. 3, the housing 1 may have a rechargeable battery 17 installed therein. The high-pressure bag 16 may be coupled to the arc emission end 13 and the circuit board 18. The control rod seat 8 of FIG. 2 may have a rectangular projection 14 disposed at a rear end of the control rod seat 8. In FIGS. 1, 3, and 4, the housing 1 has a restoring spring 15 installed therein, and an end of the restoring spring 15 abuts against the rectangular projection 14 (FIG. 2). The restoring spring 15 may provide for returning the control rod seat 8 to the initial lock status.

In FIGS. 5 and 6, the restoring torsion spring 4 has an end abutting against the inner side of the housing 1 and the other end hooking onto a hook projection 19 of the locking lever 3, and the hook projection 19 and the locking projection 5 are coaxially configured.

During use, the safety push button 9 of the control rod seat 8 is pushed forward, and the flange 10 presses the contact end 12, so that the locking projection 5 is separated from the engaging groove 6, and then the lighter switch 2 is pressed for operation of the lighter. Now, a lower end surface 20 of the locking lever 3 is disposed on an upper end surface 21 of the lighter switch 2, so that the locking projection 5 can be latched into the limit slot 11 to provide the positioning effect to the whole control rod seat 8. After the lighter switch 2 is pressed, the pushing force applied to the safety push button 9 may be released. After the lighter is completed and the lighter switch 2 is released, the lighter switch 2 may be reset, so that the locking projection 5 falls into the engaging groove 6 again, and the whole control rod seat 8 is resumed to its initial position by the restoring spring 15, and the whole control rod seat 8 returns to its locked status.

In the arc lighter of this embodiment, the design of the safety lock can lock the lighter switch. During use, it is necessary to push the safety push button forward, so that the locking projection of the locking lever is separated from the engaging groove of the lighter switch, and then the lighter switch can be pressed to touch the circuit board switch for lighter. Normally, the arc emission end is disposed in the protective cover. When the safety push button is pushed, the arc emission end can be pushed out from the protective cover, so as to provide the effect of protecting the arc emission end. This disclosure has the advantages of simple overall structure, high safety coefficient, safe and reliable use.

Figure 8:
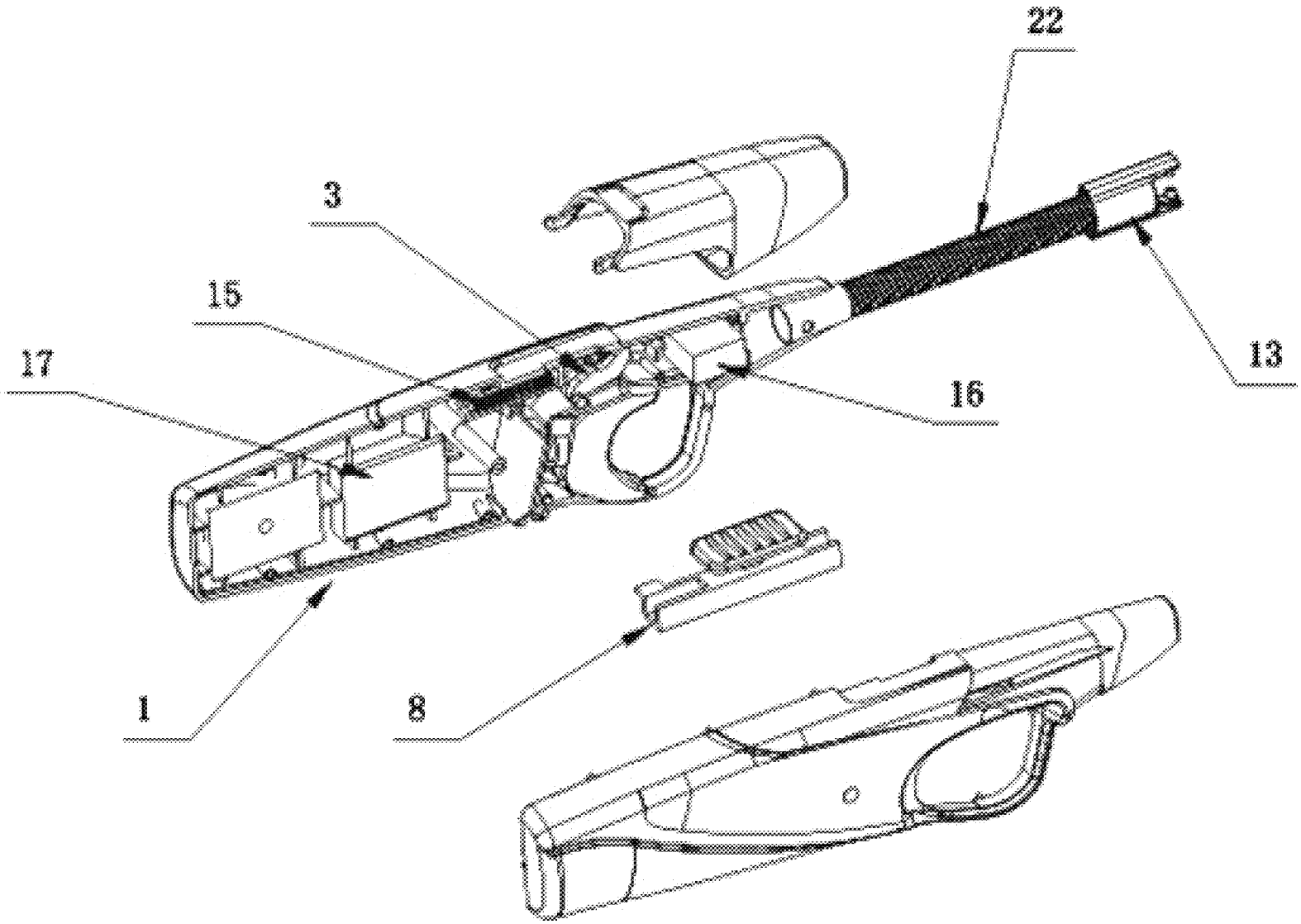
FIG. 8 is an exploded view of a lighter in accordance with a second embodiment of this disclosure.
Figure 9:
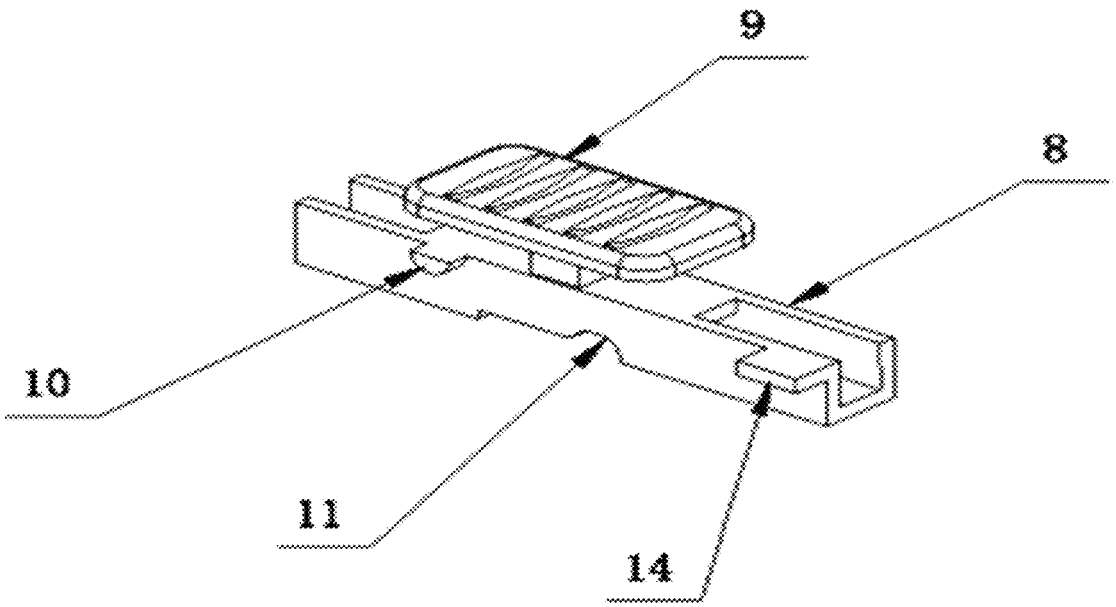
FIG. 9 is a perspective view of a control rod seat of a lighter in accordance with the second embodiment of this disclosure.

FIGS. 8 and 9 may illustrate an additional embodiment incorporating a metal hose 22 in lieu of the rigid protective housing 7 of FIG. 1. Metal hose 22 may be installed at an end of the housing 1 in this embodiment, with the arc emission end 13 installed at an end of the metal hose 22, and the high-pressure bag 16 installed in the housing 1. The structure and operation principle of the safety lock of this embodiment is generally the same as those discussed above with respect to the first embodiment and may have the same effect of effectively preventing children from operating the lighter by accident.

In the arc lighter of this embodiment, the design of the safety lock can lock the lighter switch. When use, it is necessary to push the safety push button forward to separate the locking projection of the locking lever from the engaging groove of the lighter switch before pressing the lighter switch to touch the circuit board switch for lighter. This disclosure has the advantages of simple overall structure, high safety coefficient, safe and reliable use.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An arc lighter, comprising:
- a housing;
- a lighter switch installed on the housing;
- a safety lock installed in the housing and comprising:
  - a locking lever hinged to an inner side of the housing;
  - a restoring torsion spring installed on the locking lever; and
  - a locking projection disposed at an end of the locking lever,
  - wherein the locking lever has a contact end disposed at another end away from the locking projection, further comprising:
    - a control rod seat installed into the housing and configured to slide within the housing, the control rod seat having a safety push button installed thereon, a flange, and a limit slot formed under the safety push button,
    - wherein when the safety push button is pushed forward to unlock the safety lock, and when the flange touches and presses the contact end, the locking projection is separated from the engaging groove and latched into the limit slot; and
- a circuit board installed in the housing and comprising a circuit board switch,
- wherein the locking projection engages with an engaging groove of the lighter switch to prevent the lighter switch from touching the circuit board switch.

2. The arc lighter of claim 1, wherein the locking projection is separated from the engaging groove during operation of the lighter, and wherein the locking projection is pressed against the lighter switch during the operation of the lighter, and wherein a lower end surface of the locking lever under the locking projection is disposed on an upper end surface of the lighter switch.

3. The arc lighter of claim 1, further comprising a protective cover installed on a front side of the housing, wherein the control rod seat falls into the protective cover.

4. The arc lighter of claim 3, wherein when the safety push button is pushed to the front side of the housing, and when the front end of the control rod seat is pushed out from the protective cover, the locking projection is separated from the engaging groove and latched in the limit slot in an unlocked status.

5. The arc lighter of claim 3, wherein the control rod seat has an arc emission end disposed at the front end of the control rod seat, and wherein:
- the arc emission end falls into the protective cover absent operation of the safety push button; and
- the arc emission end is extended out from the protective cover in an unlocked status when the safety push button is pushed to the front side of the housing.

6. The arc lighter of claim 5, wherein the control rod seat has a high pressure bag installed therein and coupled to the arc emission end and the circuit board, and wherein the housing has a rechargeable battery installed therein.

7. The arc lighter of claim 5, wherein the control rod seat has a rectangular projection disposed at a rear end of the control rod seat, and wherein the housing has a restoring spring installed therein having an end that abuts against the rectangular projection.

8. The arc lighter of claim 5, wherein the restoring torsion spring has an end abutting against the inner side of the housing inner side and another end hooking onto a hook projection of the locking lever.

* * * * *